United States Patent [19]

Altenpohl et al.

[11] 4,228,635

[45] Oct. 21, 1980

[54] POULTRY BAGGING SYSTEM

[75] Inventors: William F. Altenpohl; Paul J. Altenpohl, both of High Point, N.C.

[73] Assignee: W. F. Altenpohl, Inc., High Point, N.C.

[21] Appl. No.: 2,705

[22] Filed: Jan. 10, 1979

Related U.S. Application Data

[63] Continuation-in-part of Ser. No. 845,231, Oct. 25, 1977.

[51] Int. Cl.[3] ..... B65B 43/36; B65B 39/02

[52] U.S. Cl. ..... 53/572; 53/261; 53/385; 17/44.1

[58] Field of Search ..... 53/384, 385, 386, 570, 53/572, 260, 261, 262; 17/44.1

[56] References Cited

U.S. PATENT DOCUMENTS

| | | | |
|---|---|---|---|
| 2,899,788 | 8/1959 | Beebe | 53/262 |
| 3,206,913 | 9/1965 | Fleigher et al. | 53/385 X |
| 3,751,762 | 8/1973 | Dillon | 17/44.1 X |
| 3,988,874 | 11/1976 | Altenpohl et al. | 53/62 X |
| 4,141,194 | 2/1979 | Rochman | 53/385 X |

*Primary Examiner*—Travis S. McGehee

*Attorney, Agent, or Firm*—Clarence A. O'Brien; Harvey B. Jacobson

[57] ABSTRACT

Fresh processed poultry suspended by double leg hooks from conveyor mounted carriers are dropped onto an inclined guide surface of a bagging device having a stack of flexible film bags positioned to receive the dropped birds. Each bird is suspended from its carrier by a hook that pivots downwardly when released, resulting in free fall to an angular impact position substantially matching the incline of the guide surface along which the bird descends into an opened bag.

16 Claims, 9 Drawing Figures

2
16
14
20
26
58
18
70
54
12
30
10
52
34
2

POULTRY BAGGING SYSTEM

BACKGROUND OF THE INVENTION

This invention relates in general to the packaging of poultry in flexible film bags as disclosed in our prior copending U.S. application, Ser. No. 845,231, filed Oct. 25, 1977, with respect to which the present application is a continuation-in-part.

Present production marketing trends have seen a dramatic increase in the packaging of poultry within tightly fitting, flexible film bags, whereby the customer may first examine the product through a transparent portion of the packaging film and quickly read the information imprinted on the film, such as weight and price, in order to make a purchase judgment. The packaging of poultry in flexible film bags has been an essentially manual operation because of the difficulty in loading irregular shaped products such as poultry into tightly fitting bags. The bagging operation is further complicated by the necessity to match the size of the bird to correspondingly sized weight-marked bags.

According to present bagging practice, processed poultry loaded onto a conveyor are delivered to a bagging station at which personnel remove each bird from the conveyor, weigh it, select an appropriate sized, weight-marked bag from a bag rack, load the bird into the selected bag and place the bagged bird onto a conveyor for delivery to a bag sealing station. Such bagging procedures are slow and therefore limit production speed or require a plurality of simultaneous operations to increase the output at an increased cost of equipment and labor. Further, because of the use of personnel to manually perform the various steps in the packaging operation, the production rate becomes erratic and mismatch between bird weight and bag size occurs.

Automatic weight sorting apparatus are well known, such as disclosed in U.S. Pat. Nos. 3,291,303 and 3,680,693, to Altenpohl. The use of such weight sorting apparatus in combination with the packaging of poultry in cartons has already been disclosed in applicants' prior to U.S. Pat. No. 3,988,874. Also, well known in the art are bagging devices such as disclosed in U.S. Pat. No. 3,727,274 to Williams, adapted to handle the flexible film bags aforementioned. However, prior to the invention disclosed in our prior copending application aforementioned, no automated packaging of poultry in such flexible film bags was practical or feasible because of the problems inherent in the loading of relatively large and irregular shaped products such as poultry into bags with the required tight fit and at a high enough production speed to warrant the cost.

U.S. Pat. No. 2,899,788 to Beebe expressly relates to the loading of poultry into flexible film bags using pivoted guide sections to hold the bag open and guide a bird into the bag. In both the Williams patent aforementioned and the Beebe patent, the article being bagged descends into the bag along a gravitationally vertical guided surface. Further, with respect to bagging of poultry the Beebe patent is expressly limited to a manual bagging procedure as evidence of the prior bagging practice hereinbefore referred to. As to the suspension of birds from a poultry carrier, the use of double leg hooks is well known as disclosed, for example, in U.S. Pat. No. 3,751,762 to Dillon. However, no double leg hooks have ever been used for suspension of poultry dropped either at a weighing or at a packaging station as far as applicants are aware.

It is therefore an important object of the present invention to provide apparatus for automatic loading of poultry into tightly fitting flexible film bags.

SUMMARY OF THE INVENTION

In accordance with the present invention, poultry is suspended from an overhead conveyor by a carrier having a pivoted hook for signal controlled drop of poultry at a bagging station. By virtue of such suspension, poultry may be properly guided without tumbling into a flexible film bag despite variations in contour and the small allowance between the opened bag volume and the product received therein. The birds are therefore suspended from both legs as compared to a single point suspension ordinarily associated with weight sorting operations at which birds are dropped under signal control. The bagging device utilized is operatively positioned relative to the drop point so that the bird will enter an opened bag with an impact force sufficient to detach the bag from its holding rack and yet deposit the bagged bird onto a receiver surface without excessive bounce.

According to the present invention, the hook aforementioned is of the two leg engaging type pivotally mounted on the carrier and held by a latch at an upward incline for pivotally suspending a bird. Upon release of the latch, the hook rotates downwardly under load and the bird slides off the hook to undergo a short free fall along a vertical path before impact with an inclined guide surface of the bagging device along which the bird continues to descend into an open bag. Prior to release, the bird is so suspended that its center of gravity will be vertically aligned below the leg suspension points with the back side of the bird facing laterally outward from the hook pivot point. During release, pivotal movement of the leg engaging hook will angularly displace the center of gravity of the bird in a lateral direction opposite to radially outward movement of the leg suspension points on the hook. Accordingly, the bird acquires a predetermined angular position relative to the initial vertical suspension position, corresponding to a predetermined angle in a vertical plane perpendicular to the path of carrier movement. This angle is substantially equal to the incline of the guide surface terminating free fall descent of the bird. Because of such angular match and contact of the back side of the bird with the guide surface, impact pressures exerted by the guide surface and distortion of the bird are minimized and any tendency for tumbling is eliminated. As a result, successful automatic bagging in a reliable and economically feasible manner is achieved.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
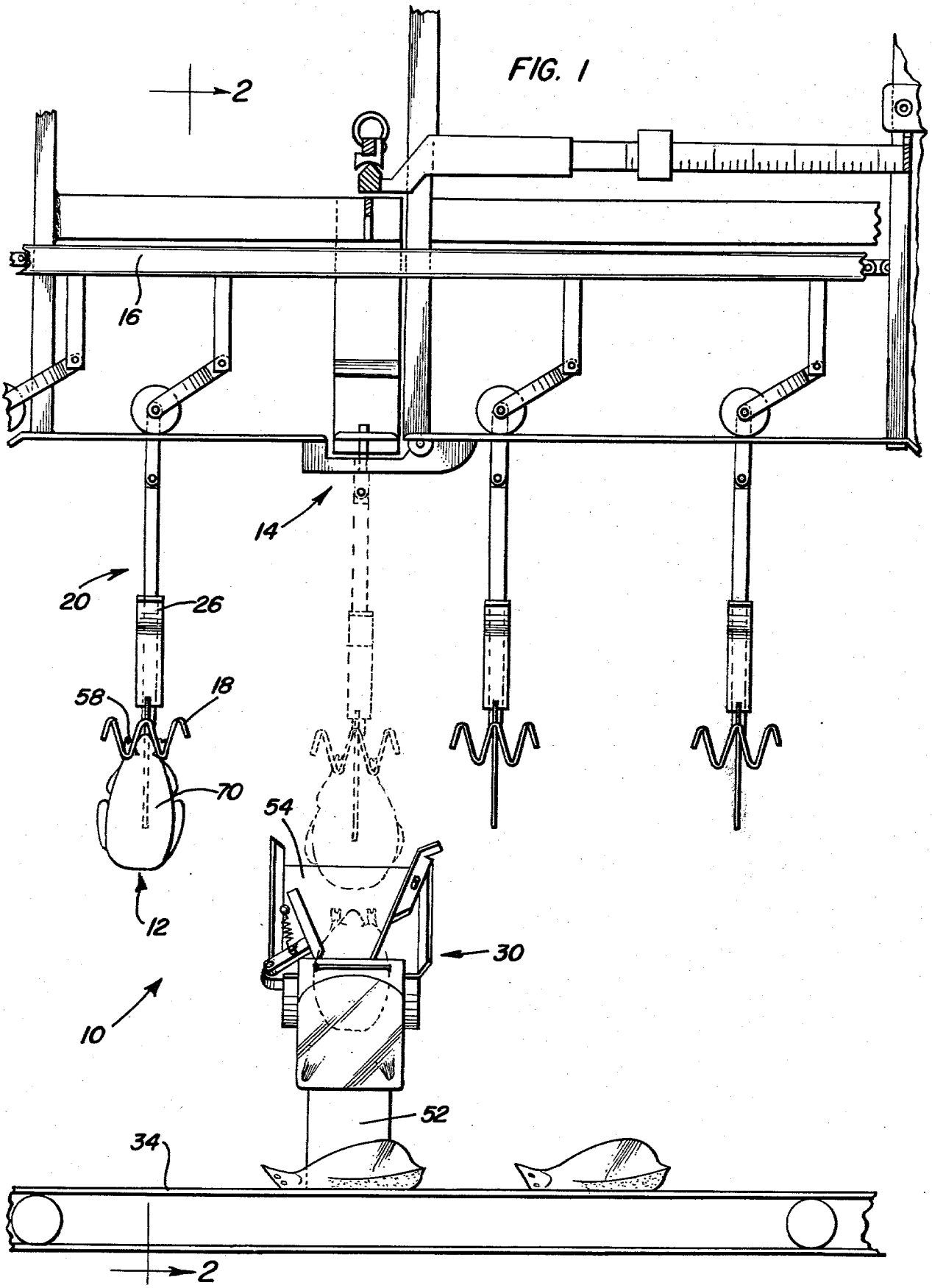
FIG. 1 is a partial side elevational view of the apparatus of the present invention at a bagging station.
Figure 2:
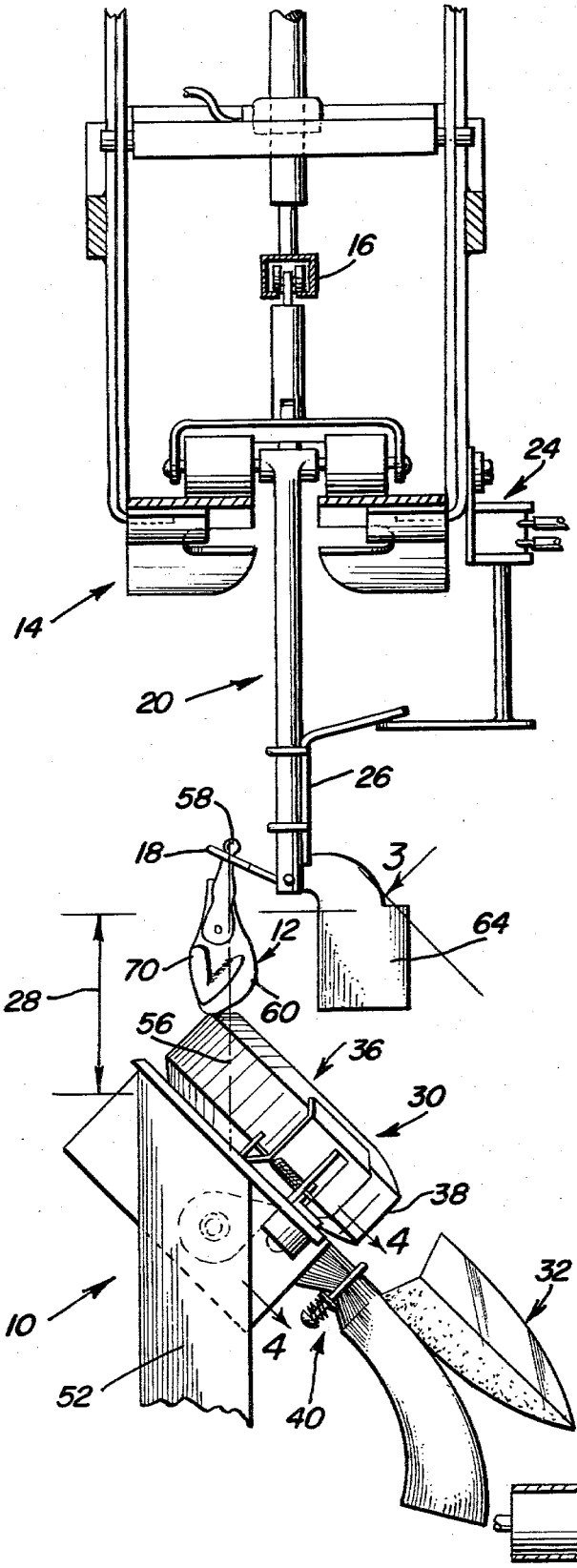
FIG. 2 is a transverse section view of the apparatus taken substantially through a plane indicated by section line 2—2 in FIG. 1.
Figure 3:
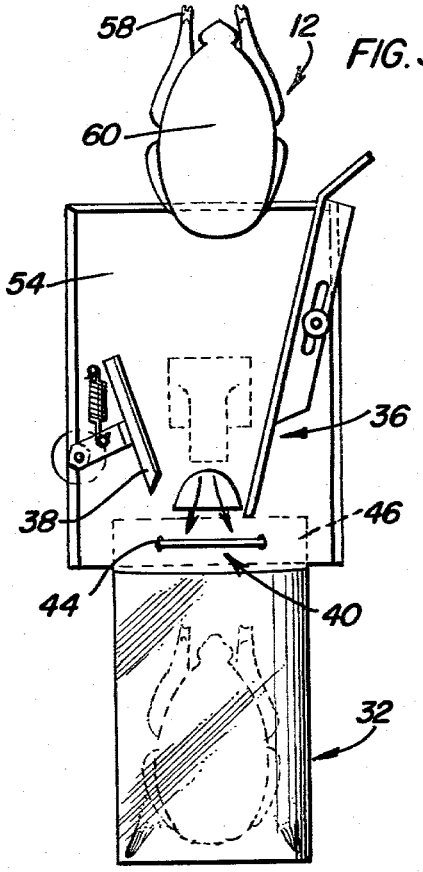
FIG. 3 is a view taken substantially from a plane indicated by section line 3—3 in FIG. 2.
Figure 4:
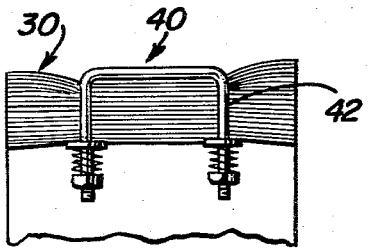
FIG. 4 is an enlarged partial section view taken substantially through a plane indicated by section line 4—4 in FIG. 2.

Referring now to the drawings in detail, FIGS. 1 and 2 illustrate a single bagging station generally referred to by reference numeral 10 to which birds 12 within a predetermined weight range are delivered by a weight-sorting apparatus generally referred to by reference numeral 14. The weight-sorting apparatus shown is of the type disclosed in U.S. Pat. No. 3,680,693 aforementioned wherein signal operated release is effected from single point suspension carriers. Such apparatus includes a horizontal overhead conveyor 16 from which the birds are suspended for movement along a horizontal conveyor path. The birds are, however, suspended by double leg hooks 18 associated with carriers 20 connected to the conveyor in accordance with the present invention. The load on the carriers is transferred to a fixed track 22 approaching the bagging station at which a load within a preset weight range is released or dropped. Thus, birds within the predetermined weight range will effect operation of a signal operated release mechanism 24 to upwardly retract a latch 26 and release the hook 18 to drop a bird at the bagging station. Each bird when dropped descends a predetermined free fall distance 28 denoted in FIG. 2 before it contacts a bagging device generally referred to by reference numeral 30, with which a stack of flexible film bags 32 are associated. As each bird is received in a bag 32, the bag becomes detached from the bagging device 30 and falls onto the moving receiver surface or upper run of an unloading conveyor belt 34, adapted to deliver the bagged birds to a bag sealing station (not shown). The upper run of the conveyor belt moves in a direction generally parallel to the path of travel of the overhead conveyor 16.

The bags 32 associated with any given bagging station 10 are of a size which corresponds to the weight range of the birds dropped from the associated weight-sorting apparatus 14 so as to package the bird with a minimal amount of internal air space remaining. The bagging device 30 includes a guide assembly 36 having a pair of spring-biased pivoted guide arms 38 that project into the mouth of the top bag held open by a blower air stream. A stack of bags 32 are held on a rack 40 having a pair of holding pins 42 extending through aligned holes 44 formed in the top flap portion 46 of each bag. The distance between the holes 44 and the top edge of the flap portion 46 are such as to accommodate rupture under impact when a bird enters the bag with a predetermined impact velocity or momentum. In this manner, the bag is detached from the rack 40 to effect gravitational transfer of each bagged bird to the conveyor belt 34.

As more clearly seen in FIG. 2, the bagging device 30 is operatively mounted by any suitable supporting frame structure 52 so that a slide surface 54 thereof is inclined at a predetermined angle, with its upper end portion intersecting a gravitationally vertical path of fall 56 of the bird to determine the free fall distance 28. The free fall distance is such as to enable the bird to acquire sufficient velocity to produce a bag detaching impact. The guide surface 54 guides the bird along an inclined path laterally of the carrier conveyor path into the opened bag to regulate impact and avoid tumbling. For proper operation, the bird must be suspended by the legs 58 and orientated so as to cause the bird to slide on its back along surface 54. With a surface 54 made of stainless steel and lubricated by water, birds that are freshly slaughtered and processed in a poultry processing plant will be in a properly pliable state to easily slide into the bag 32 and deliver the requisite impact force to effect bag detachment. Of course, only birds within the operational weight range of the weight sorting apparatus 14 will be accommodated by the size-matched bags 32.

Figure 5A:
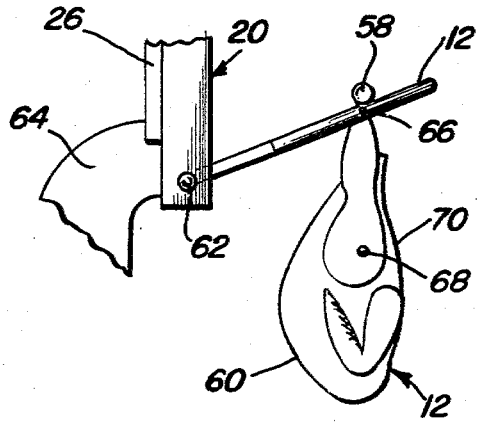
FIGS. 5A–5D are enlarged, partial side elevation views showing the release and dropping of a bird into the bagging device in different stages.

As more clearly seen in FIG. 5A, the hook 18 is mounted at the lower end of carrier 20 by a pivot 62 and is held in its upwardly inclined position by latch 26 received in a notch formed in counterweight 64. Except for the double leg engaging configuration of the hook 18, the carrier 20 and its operation is well known in the art.

Figure 5B:
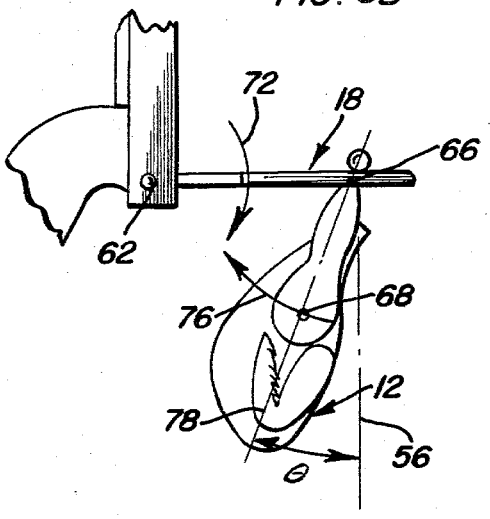
Figure 5C:
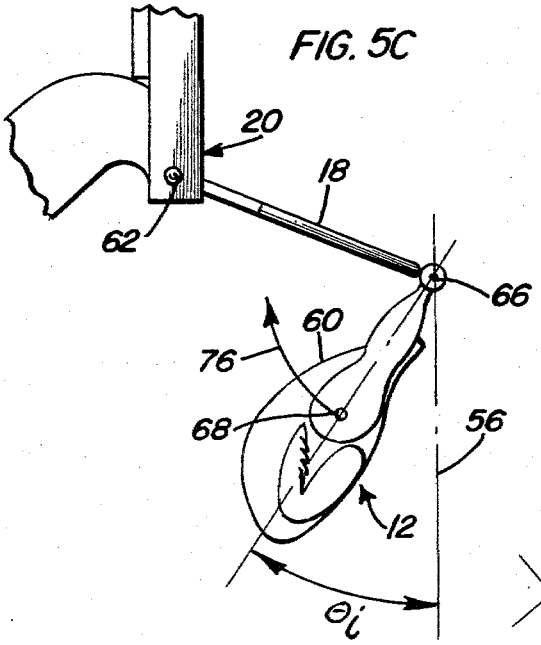
Figure 5D:
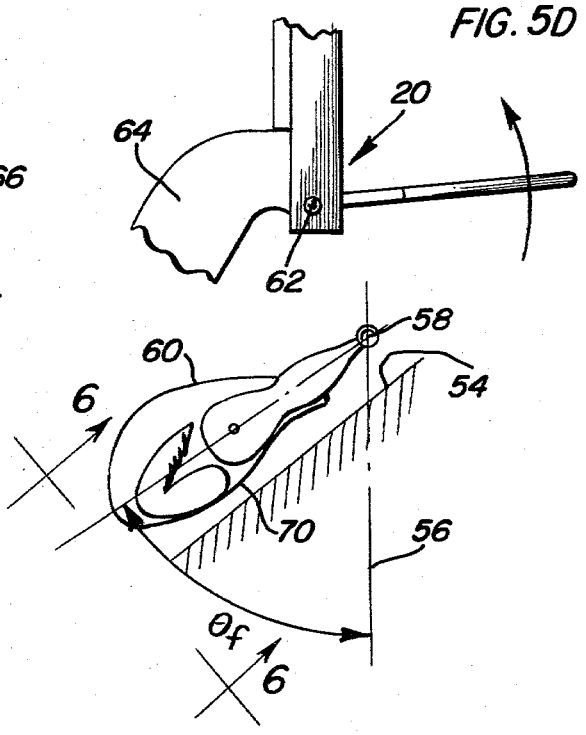
Figure 6:
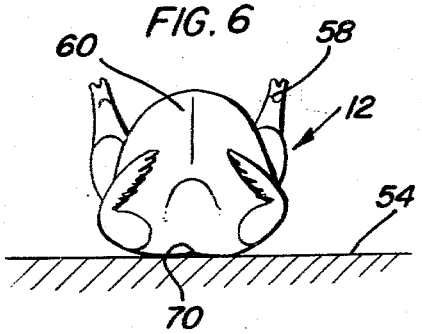
FIG. 6 is an end view of the bird on the inclined guide surface as seen from a plane indicated by section line 6—6 in FIG. 5D.

An important aspect of the present invention believed to be responsible for successful automatic bagging of poultry, resides in the selection of the particular type of hook 18 and the orientation of the bird 12 pivotally suspended from the hook at leg suspension points 66 aligned in the direction of carrier movement as shown in FIG. 5A. The bird will have its center of gravity 68 vertically aligned below the suspension points 66 in the vertically suspended position. The breast 60 of the bird faces the pivot 62 while the back side 70 of the bird faces laterally away therefrom. When the latch 26 is elevated to release the the hook 18, the hook pivots downwardly or clockwise as viewed in FIG. 5B and denoted by angular motion vector 72. The suspension points 66 will therefore move radially outward along the hook as denoted by vector 74 causing clockwise angular movement of the center of gravity 68 relative to the suspension points 66 as denoted by angular motion vector 76 in FIG. 5B. The angle $\theta$ between the line 78, interconnecting the center of gravity and the suspension points, and the vertical path of fall 56 through the suspension points, will therefore increase as the hook 18 continues to rotate toward its final release position as shown in FIG. 5C at which point the bird 12 leaves the hook. The angular position or orientation of the bird at that instant reflected by the angle $\theta_i$ continues to change by a slight amount because of momentum as the bird undergoes free fall. Free fall is terminated by the guide 54 as shown in FIG. 5D at which instant the angular orientation of the bird will reach an impact angle $\theta_f$. The incline of the surface 54 is substantially equal to $\theta_f$ corresponding to the angular orientation of the bird upon impact. Impact pressures and distortion of the bird are thereby minimized and tumbling avoided. The descent of the bird into the bag continues along the slide surface 54 on which orientation of the bird is stabilized. For this reason, the back side 70 of the bird contacts the slide surface as more clearly seen in FIG. 6 for more stable guided support. It will be apparent that greater contact surface is offered by the bird anatomy on the back side 70 as compared to the breast side 60, which accounts for the stable orientation of the bird as it enters the bag.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a bagging device having a fixed slide surface adapted to guide movement of a product into an opened bag with a tight fit, and a carrier releasably suspending the product during travel along a conveyor path overlying the slide surface, the improvement residing in hook means for suspending the product on the carrier at two suspension points, means mounting the hook means on the carrier for pivotal displacement, release means engageable with the hook means for effecting gravity induced displacement thereof to a release position causing free fall of the product along a vertical path to an impact position on said slide surface, and frame means mounting the bagging device in operative relative to the carrier with the slide surface positioned at an angle of incline to said vertical path substantially matching the impact position for terminating said free fall of the product and guiding continued descent thereof into the opened bag.

2. The combination of claim 1 wherein said two suspension points are aligned in the direction of said conveyor path.

3. The combination of claim 2 wherein said hook means is pivotally displaced in a transverse plane substantially perpendicular to the conveyor path.

4. The combination of claim 3 wherein the product is angularly displaced relative to said suspension points by radially outward movement thereof during said pivotal displacement of the hook means.

5. The combination of claim 4 wherein said product is poultry having a breast portion, a back side and a pair of legs, said suspension points being located on the legs.

6. The combination of claim 5 wherein said back side impacts the slide surface upon termination of the free fall.

7. The combination of claim 1 wherein said hook means is pivotally displaced in a transverse plane substantially perpendicular to the conveyor path.

8. The combination of claim 1 wherein the product is angularly displaced relative to said suspension points by radially outward movement thereof during said pivotal displacement of the hook means.

9. The combination of claim 1 wherein said product is poultry having a breast portion, a back side and a pair of legs, said suspension points being located on the legs.

10. The combination of claim 9 wherein said back side impacts the slide surface upon termination of the free fall.

11. In combination with a carrier having a hook releasably suspending poultry traveling along a conveyor path and a bagging device having a fixed slide surface establishing a guide path into an opened bag, means for enabling automatic loading of said poultry into the opened bag with a tight fit in response to signal operated release from the hook, including engaging means on the hook for pivotal and slidable suspension of the poultry, means mounting the hook on the carrier for pivotal displacement when released to slidably drop the poultry for free fall to an angular impact position on the slide surface, and frame means mounting the slide surface at an incline substantially matching the angular impact position for interrupting said free fall.

12. The combination of claim 11 wherein said hook engaging means suspends the poultry at two locations aligned in the direction of said conveyor path.

13. The combination of claim 12 wherein said poultry includes a breast portion, a back side, and a pair of legs at said two locations.

14. The combination of claim 13 wherein said back side impacts the slide surface upon termination of the free fall.

15. The combination of claim 11 wherein said poultry includes a breast portion and a back side, said back side contacting the slide surface upon termination of said free fall.

16. In combination with a bagging device having a fixed slide surface adapted to guide movement of a product into an opened bag, and a carrier conveying said product along a conveyor path in a vertically suspended position, means for enabling automatic loading of the product into the opened bag with a tight fit in response to signal-operated release of the product from the carrier during travel, including hook means on the carrier displaceable to a release position from which the product descends under free fall along a vertical path laterally spaced from said conveyor path, said product undergoing free fall to an impact position at an angle to said vertical path, and frame means mounting the slide surface at an incline to the vertical path substantially equal to said angle for terminating the free fall of the product before entry into the opened bag.

* * * * *